US008122523B2

(12) United States Patent
Li

(10) Patent No.: US 8,122,523 B2
(45) Date of Patent: Feb. 28, 2012

(54) TOILET SEAT HINGE

(76) Inventor: Yonghua Li, Zhongshan (CN)

( * ) Notice: Subject to any disclaimer, the term of this patent is extended or adjusted under 35 U.S.C. 154(b) by 260 days.

(21) Appl. No.: 12/454,794

(22) Filed: May 22, 2009

(65) Prior Publication Data

US 2010/0005579 A1 Jan. 14, 2010

(51) Int. Cl.
*A47K 13/12* (2006.01)

(52) U.S. Cl. ..... 4/236; 4/240

(58) Field of Classification Search ..... 4/234, 236, 4/237, 240, 241, 248
See application file for complete search history.

(56) References Cited

U.S. PATENT DOCUMENTS 2,431,263 A * 11/1947 Lundgren ..... 4/236
(Continued)

*Primary Examiner* — Dinh Nguyen
*Assistant Examiner* — Jennifer Gordon
(74) *Attorney, Agent, or Firm* — Raymond Y. Chan; David and Raymond Patent Firm

(57) ABSTRACT

A toilet hinge includes a hinge body adapted for pivotally coupling with the toilet seat, a hinge base, which is adapted for attaching on the toilet bowl of the toilet, detachably coupled with the hinge body for detachably coupling the toilet seat on the toilet bowl; and a locking arrangement which includes a retention lock operatively moving between a locking status that locks up the hinge body with the hinge base and a releasing status that unlock the hinge body the said hinge base, and a self-lock retaining the retention lock at the releasing status. The user is able to easily remove the toilet seat by unlocking the retention lock such that the retention lock is remained at the releasing status by the self-lock. Therefore, the toilet seat is adapted to be removed from the toilet bowl by detaching the hinge body from the hinge base.

17 Claims, 12 Drawing Sheets

U.S. PATENT DOCUMENTS 3,670,441 A * 6/1972 Blount ..... 4/236
5,361,423 A * 11/1994 Notzold ..... 4/237
5,515,552 A * 5/1996 Tolsma ..... 4/236
6,381,762 B1 * 5/2002 Moser ..... 4/240
2008/0271230 A1 * 11/2008 Laundre ..... 4/236

* cited by examiner

TOILET SEAT HINGE

BACKGROUND OF THE PRESENT INVENTION

1. Field of Invention

The present invention relates to a hinge, and more particularly to toilet seat hinge of toilet, which allows the toilet seat to be easily detached from the toilet bowl for cleaning purpose.

2. Description of Related Arts

A typical toilet comprises a toilet bowl and a toilet seat mounted thereon. The toilet seat is installed over the rim of the toilet bowl through a hinge. And the hinge is fastened at the rear of the toilet bowl by two screws. In this way the toilet seat can be folded along the hinge back and forth. Since the hinge is fastened on the toilet bowl by screws, it is very inconvenient to remove the hinge, as well as the toilet seat which is connected with the hinge. This makes it difficult to clean the rim of the toilet bowl, and the toilet seat.

There are some toilet seats which are developed to be removable. In this way the whole toilet seat can be removed from the toilet bowl, so the rim of the toilet bowl can be cleaned without the barrier of the hinge, also the whole toilet seat can be cleaned separately. While these types of toilet seats are either not easy to remove and re-install, or not secured over the toilet bowl of the toilet. It is necessary to developed a new device which can secure the toilet seat, and also easy to be removed and re-installed.

SUMMARY OF THE PRESENT INVENTION

The main object of the present invention is to provide a toilet seat hinge, which allows the toilet seat to be easily detached from the toilet bowl for cleaning purpose.

Another object of the present invention is to provide a toilet seat hinge, which is easy for the toilet seat to be installed on the toilet bowl.

Another object of the present invention is to provide a toilet seat hinge, which connects the toilet bowl with the toilet seat securely.

Another object of the present invention is to provide a toilet seat hinge, wherein the toilet seat can be detached from the toilet bowl on one single operation of pressing a button. In addition, the toilet seat hinge can remain at its releasing status for easily removing the toilet seat from the toilet bowl. Once the toilet seat is reinstalled back to the toilet bowl, the toilet seat hinge will automatically be actuated to re-lock the toilet seat with the toilet bowl.

Accordingly, in order to accomplish the above objects, the present invention provides a toilet seat hinge for toilet seat, comprising:

a hinge body adapted for pivotally coupling with the toilet seat;

a hinge base, which is adapted for attaching on the toilet bowl of the toilet, detachably coupled with the hinge body for detachably coupling the toilet seat on the toilet bowl; and a locking arrangement which comprises a retention lock operatively moving between a locking status that locks up the hinge body with the hinge base and a releasing status that unlock the hinge body the said hinge base, and a self-lock retaining the retention lock at the releasing status.

These and other objectives, features, and advantages of the present invention will become apparent from the following detailed description, the accompanying drawings, and the appended claims.

DETAILED DESCRIPTION OF THE PREFERRED EMBODIMENT

Figure 1:
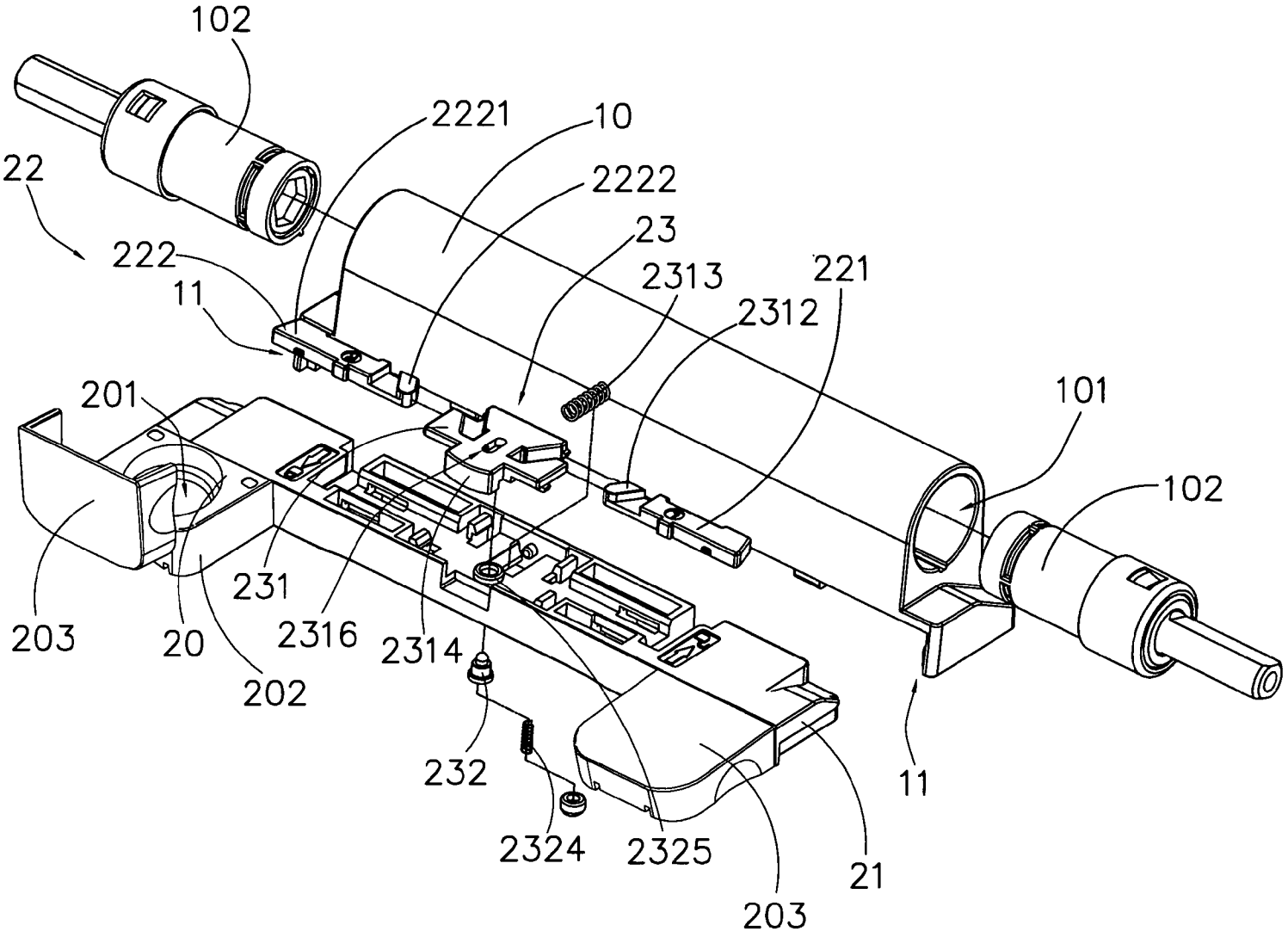
FIG. 1 is an exploded perspective view of a toilet seat hinge according to a preferred embodiment of the present invention.

Referring to FIGS. 1, 2, 15 and 16 of the drawings, a toilet seat hinge, for a toilet according to a preferred embodiment of the present invention is illustrated, wherein the hinge comprises a hinge body 10 and a hinge base 20 detachably coupling with the hinge body 10.

The hinge body 10 is adapted to pivotally couple with a toilet seat 30 so the toilet seat 30 can be opened and closed along the axis of the hinge. The hinge body 10 has a transverse hinge slot 101 provided thereon and comprises two seat joints 102 outwardly extended from two ends of the hinge slot 101 respectively for pivotally coupling with the toilet seat 30. Accordingly, the two seat joints 102 can be a soft closing hinges to provide a pivotally biasing force against the toilet seat 30 when the toilet seat 30 is pivotally folded to cover on the toilet bowl 40.

The hinge base 20 is adapted to be detachably attached on a toilet bowl 40 of the toilet. The hinge base 20 has two installation slots 201 at the left and right sides thereof respectively. The size and position of the installation slots 201 correspondingly match the holes on the rear portion of the rim of a standard toilet bowl, so the hinge base 20 can be fastened on the rear portion of the rim of the toilet bowl 40 by screws and nuts through the installation slots 201. When the hinge base 20 is fastened on the toilet bowl 40, the hinge body 10 with the toilet seat 30 can be coupled with the hinge base 20. So the hinge body 10 as well as the toilet seat 30 is mechanically connected with the toilet bowl 40. The toilet seat 30 then can be put down to cover the toilet bowl 40, or lift up to uncover the toilet bowl 40.

Referring to FIGS. 1, 2, 11 and 15 of the drawings, in a preferred embodiment of the present invention, the hinge base 20 has two installation wings 202 protruding backwardly from the two side ends of the back wall thereof. The installation slots 201 are located at the installation wings 202 respectively. In this manner, when the hinge body 10 and the hinge base 20 are coupled together, the installation slots 201 will not be covered by the hinge body 10. Therefore, during installing or uninstalling the hinge base 20, the hinge body 10 needs not be removed. The hinge base 20 also comprises two slot covers 203 pivotally connected with the installation wings 202 at the back side thereof respectively. Accordingly, when the slot cover 203 is pivotally folded to enclose the respective installation slot 201, the free edge of the slot cover 203 is engaged with the back wall of the hinge base 20 to retain the slot cover 203 in position.

Figure 16:
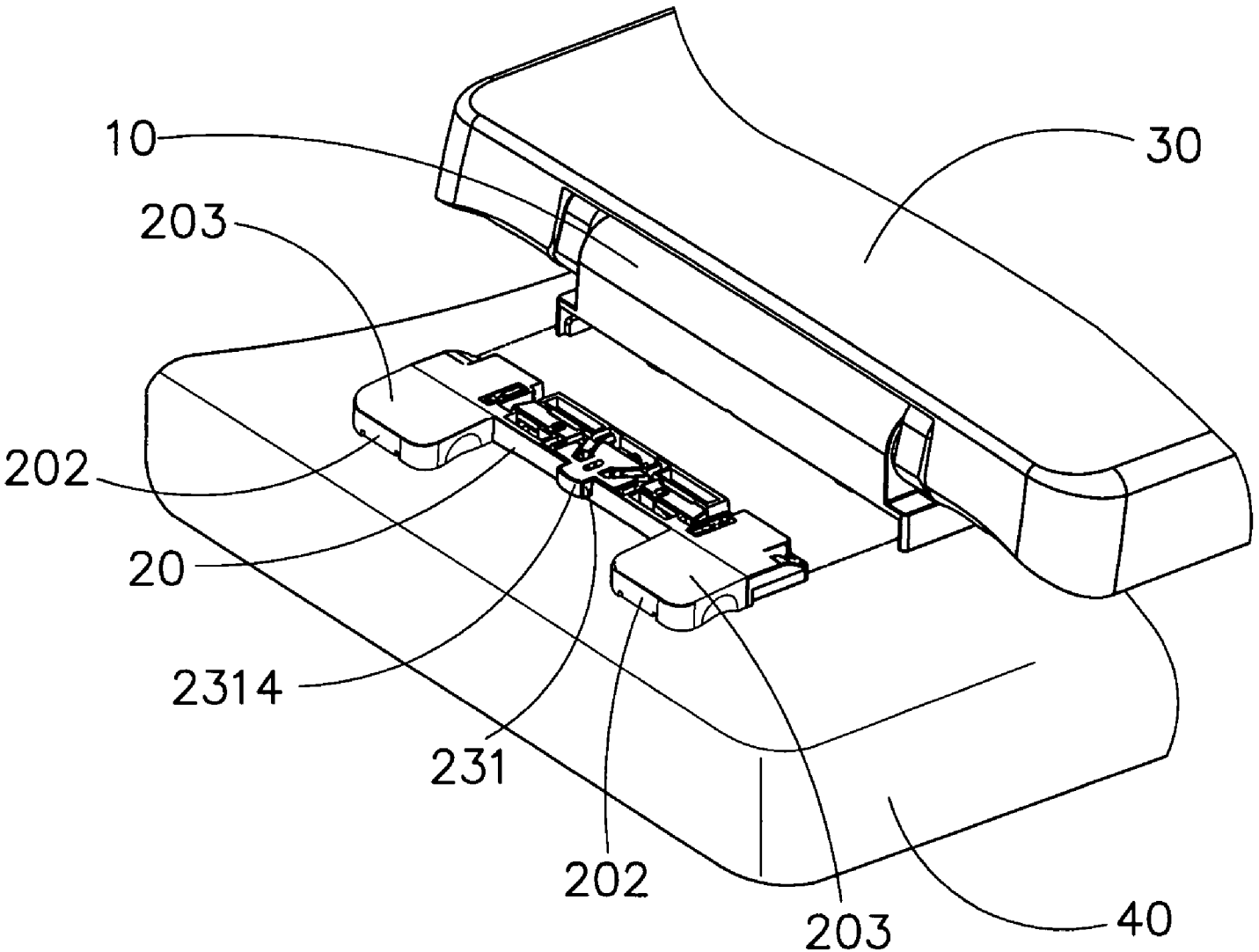
FIG. 16 is a perspective view of the toilet seat hinge according to the above preferred embodiment of the present invention, illustrating the hinge body with a toilet seat being detached from the hinge base.

The slot cover 203 can be coupled with the respective installation wing 202 to totally enclose the installation slot 201. Therefore the screws and nuts connecting the hinge base 20 and the bowl 40 will not be exposed to water. This will protect the screws and nuts from rusting. Even when the hinge body 10 is removed from the hinge base 20, the screws and nuts are still being covered, as shown in FIG. 16. It is worth mentioning when the slot cover 203 is coupled with the installation wing 202, the height of the slot cover 203 is the same as the height of the hinge base 20. In another word, the upper surface of the slot cover 203 and the upper surface of the hinge base 20 are in the same level.

Figure 15:
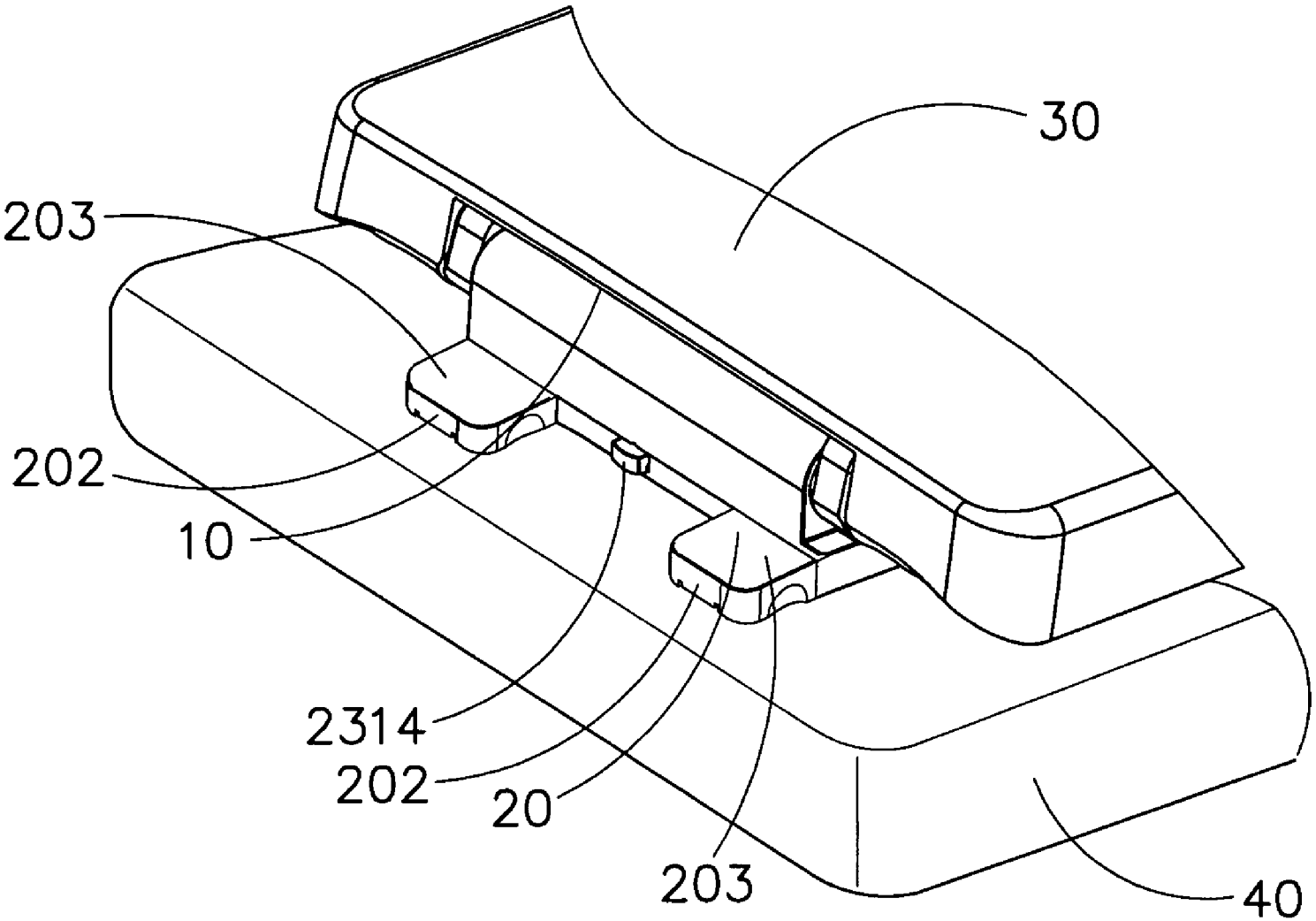
FIG. 15 is a perspective view of the toilet seat hinge according to the above preferred embodiment of the present invention, illustrating the hinge body with a toilet seat being coupled with the hinge base.

Referring to FIGS. 1, 2, 7 and 8, the hinge body 10 comprises two sliding slots 11 transversely at two side ends, i.e. the left and right ends, thereof. When the hinge base 20 is fastened on the toilet bowl 40, the two sliding slots 11 are parallel to the rim of the toilet bowl 40. Correspondingly, the hinge base 20 comprises two sliding ridges 21 transversely provided at two side ends, i.e. the left and right ends thereof. Referring to FIGS. 15 and 16, by aligning the sliding slots 11 and the sliding ridges 21, the hinge body 10 can be slid forward horizontally to the rim of the toilet bowl 40 to cover the hinge base 20. When the sliding ridges 21 of the hinge base 20 are slid to the end of the sliding slots 11 of the hinge body 10, the hinge body 10 and the hinge base 20 are coupled together, and the hinge base 20 is totally covered by the hinge body 10. The hinge body 10 can also be slid backward to be detached from the hinge base 20. In this way, the hinge body 10 with the toilet seat 30 can be easily removed away from the hinge base 20 and the toilet bowl 40. Because the sliding slots 11 and the sliding ridges 21 are matched closely, the hinge body 10 cannot move vertically when it is coupled with the hinge base 20. Therefore, during lifting and putting down the toilet seat 30, the hinge body 10 is secured.

Referring to FIGS. 1 to 14 of the drawings, the hinge further comprises a locking arrangement for detachably locking the hinge body 10 with the hinge base 20, wherein the locking arrangement comprises a retention lock 22 operatively moving between two statuses, the locking status and the releasing status. In the locking status, the retention lock 22 can lock the position of the hinge body 10 when the hinge body 10 and the hinge base 20 are coupled together. In this situation, the hinge body 10 and the hinge base 20 is securely coupled and cannot be detached even a pulling force is executed horizontally on the hinge body 10 of on the toilet seat 30. In the releasing status, the retention lock 22 has no effort over the coupling of the hinge body 10 and hinge base 20. Therefore, the hinge body 10 can be removed from the hinge base 20 freely by sliding along the sliding slots 11. It is worth to mention that when the hinge body 10 is slidably coupled with the hinge base 20, the retention lock 22 is encased within the hinge body 10 and the hinge base 20.

The locking arrangement further comprises a self-lock 23 adapted to switch and retain the retention lock 22 from locking status to the releasing status. Therefore, when the self-lock 23 is locked, the retention lock 22 remains in releasing status. The hinge body 10 can be slid back and forth freely. When the self-lock 23 is unlocked, the retention lock 22 remains in locking status. If at the moment, the hinge body 10 and the hinge base 20 are coupled together, the hinge body 10 can not be detached from the hinge base 20. The benefit of the self-lock 23 is when the retention lock 22 is switched to releasing status, the self-lock 23 will retain the retention lock 22 in this status, and the user doesn't need to take care of the retention lock 22 any more. So the user can conveniently detach the hinge body 10 from the hinge base 20 on the toilet bowl 40.

Figure 2:
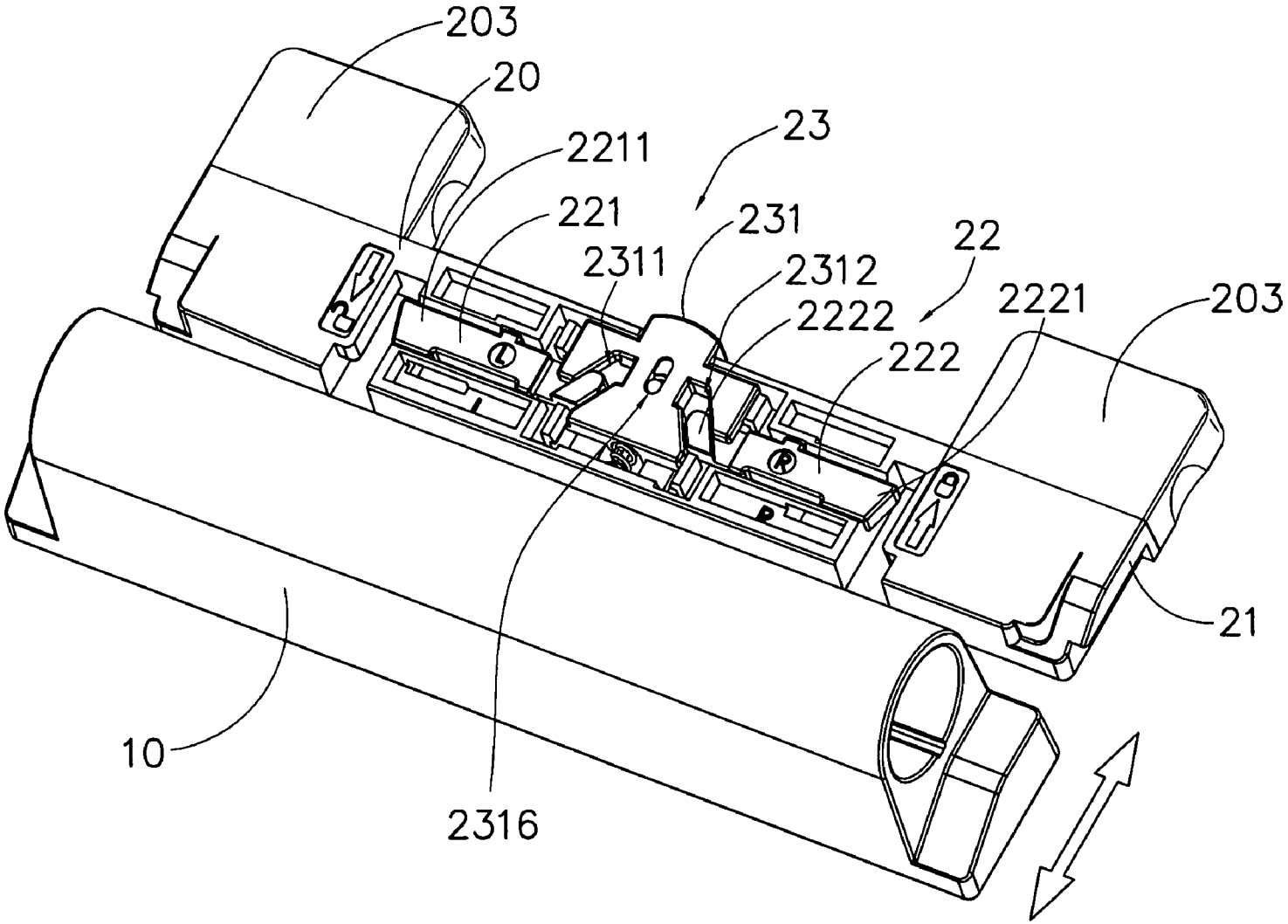
FIG. 2 is a perspective view of the toilet seat hinge according to the above preferred embodiment of the present invention.
Figure 7:
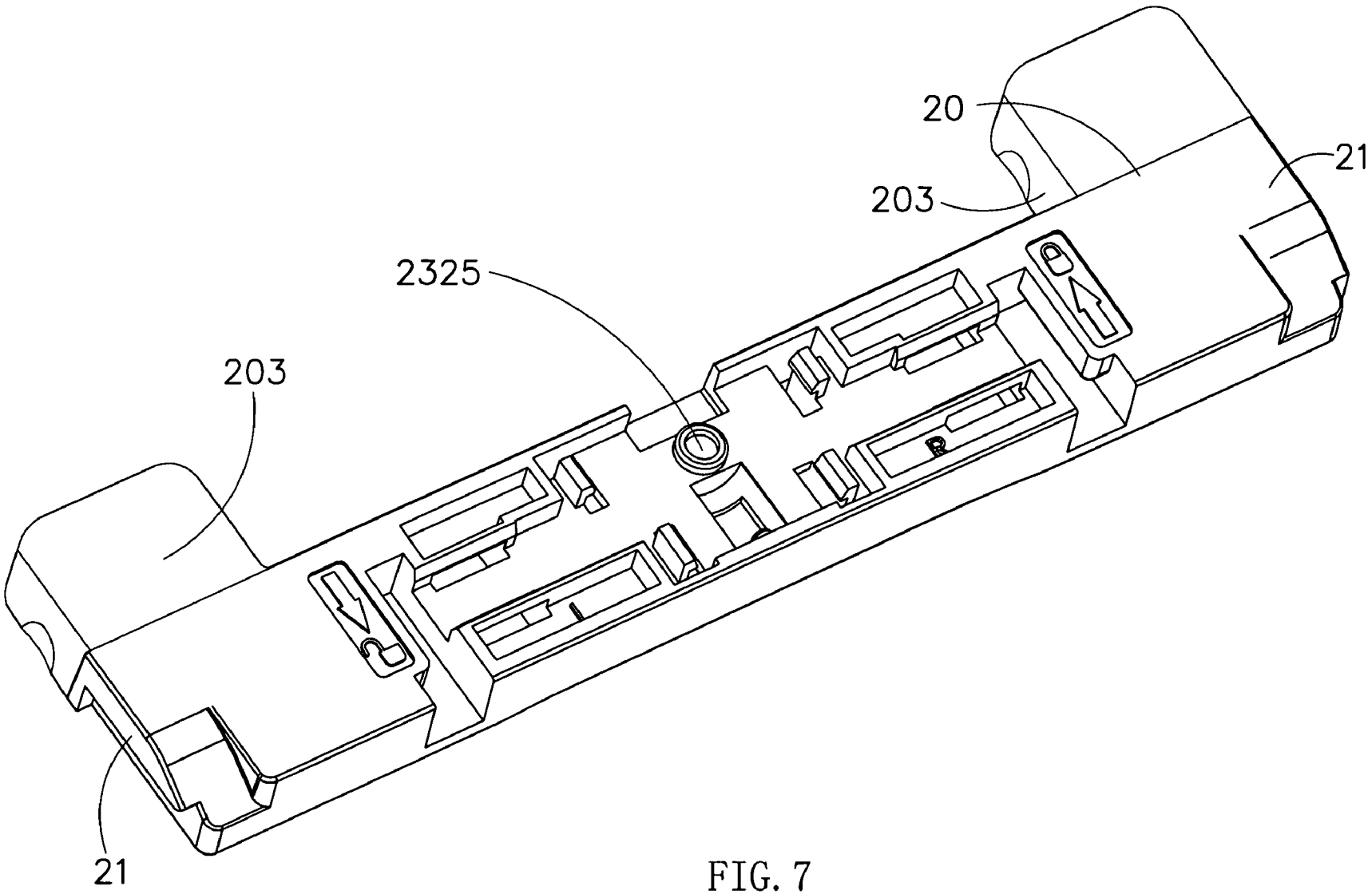
FIG. 7 is a perspective view of the hinge base according to the above preferred embodiment of the present invention.

Referring to FIGS. 1, 2 and 7, the retention lock 22 comprises two locking latches, i.e. a left locking latch 221, and a right locking latch 222, symmetrically aligned on the hinge base 20. Both two latches 221, 222 are longitudinally slidable along the hinge base 20. The hinge body 10 also comprises two locking teeth 12 provided at two inner walls of the hinge body 10 respectively. In the locking status, the two locking latches 221, 222 extend towards the two sides of the hinge base 20 respectively. In the releasing status, the two locking latches 221, 222 withdraw towards the center of the hinge base 20 respectively, the two locking teeth 12 are spacedly fixed at the hinge body 10. When the hinge body 10 and the hinge base 20 are coupled together, the two locking teeth 12 are inside the hinge base 20. At this moment, if the retention lock 22 is in locking status, the locking latches 221, 222 extend and couple with the locking teeth 12 respectively preventing the locking teeth 12 to move backward. In this way, the hinge body 10 is locked with the hinge base 20 and cannot be detached from the hinge body 10.

Figure 6:
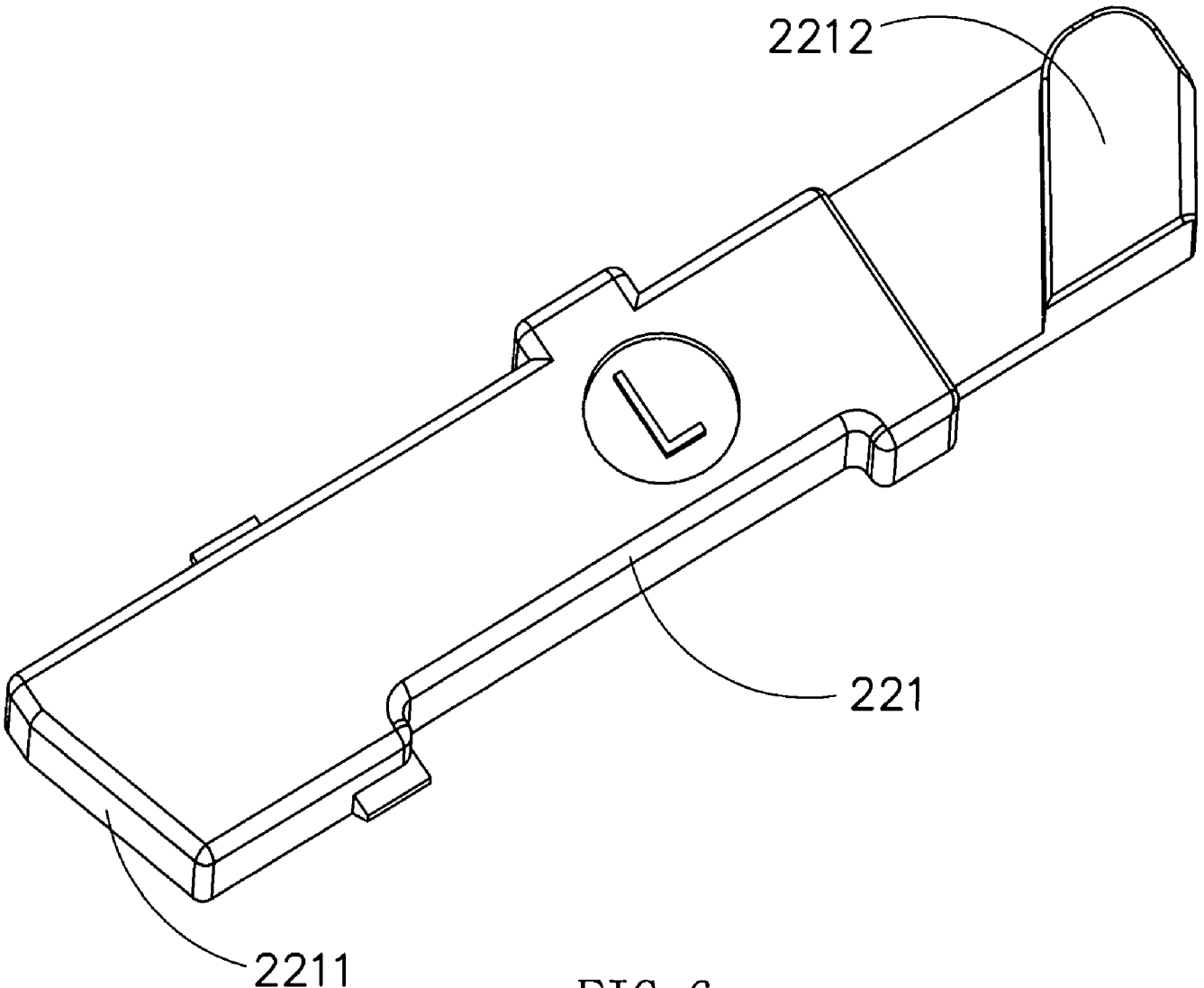
FIG. 6 is perspective view of the left latch of the hinge lock according to the above preferred embodiment of the present invention.

Referring to FIG. 6, in a preferred embodiment, the left locking latch 221 comprises an inclining end 2211 and an opposed engaging end 2212. The surface of the inclining end 2211 has an inclining surface. In other words, the left locking latch 221 has a trapezoidal shape that the rear edge of the left locking latch 221 is wider than the front edge thereof. So when the hinge body 10 is slid towards the hinge base 20, the left locking tooth 12 of the hinge body 10 biases against the inclining end 2211 and push the left locking latch 221 to move longitudinally towards the center of the hinge base 20. Symmetrically, the right locking latch 222 comprises an inclining end 2221 and an engaging end 2222. The inclining end 2221 of the right latch 222 has a similar inclining surface and can be pushed to move towards the center by another locking tooth 12 of the hinge body 10. Accordingly, a distance between the locking teeth 12 is shorter than a distance between the two inclining ends 2211 of the locking latches 221, 222. Therefore, even if the retention lock 22 is in locking status and the two locking latches 221, 222 are extending towards the two sides of the hinge base 20, the hinge body 10 can still be pushed forward and be coupled with the hinge base 20.

Figure 11:
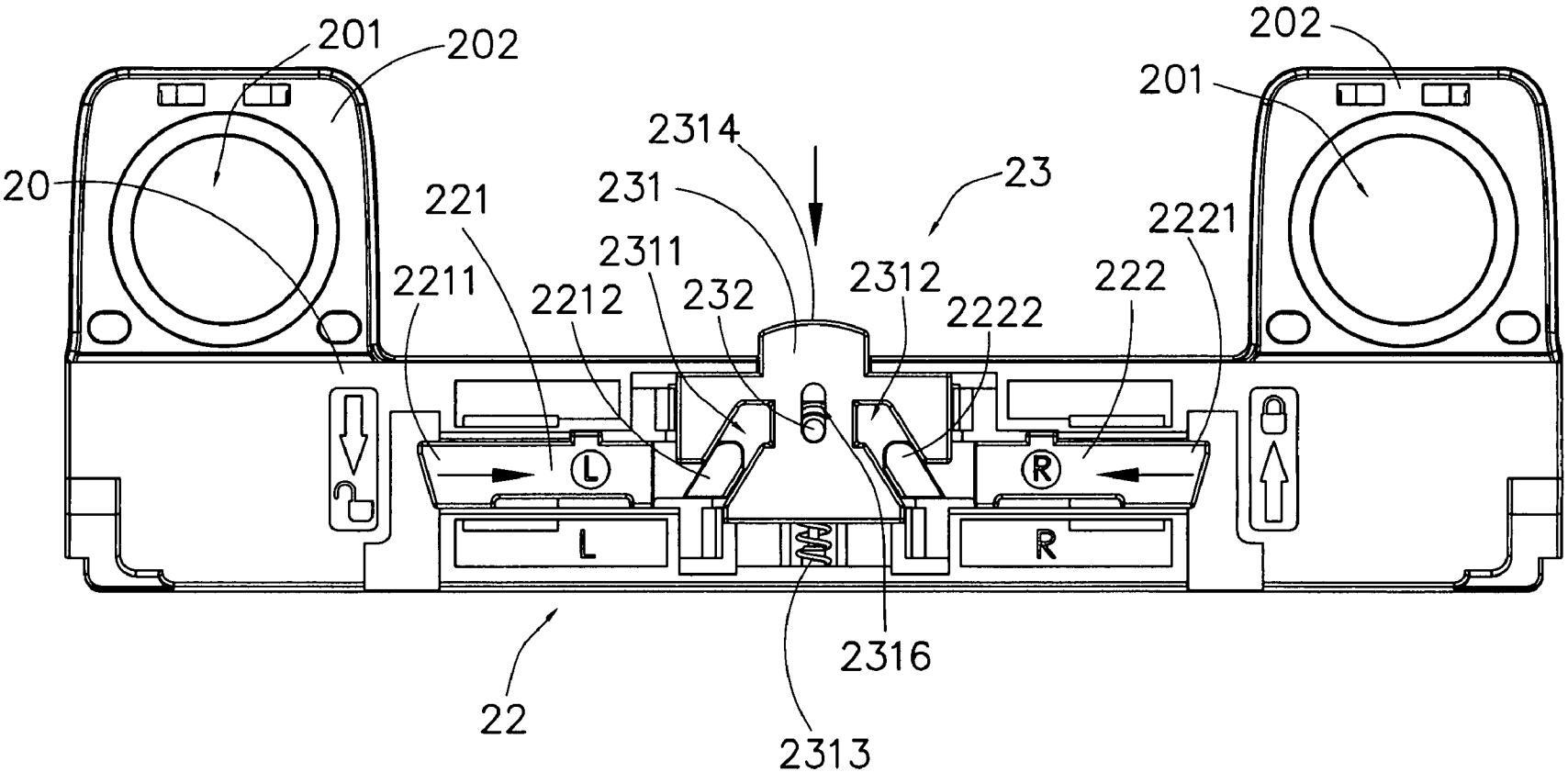
FIG. 11 is a top view of the hinge base according to the above preferred embodiment of the present invention.

The self-lock 23 is located in the center of the hinge base 20 and is slidably engaged with the engaging end 2212 of the left locking latch 221 and the engaging end 2222 of the right locking latch 222 together. Referring to FIGS. 10 to 14, the self-lock 23 comprises an engaging element 231 and a locking pin 232 upwardly and slidably extended through the engaging element 231. The engaging element 231 comprises a left inclining slot 2311 and a right inclining slot 2312. Both inclining slots 2311, 2312 have a degree with the central axis of the hinge base 20 and incline towards the center of the engaging element 231 respectively. Referring to FIG. 6, accordingly, both engaging end 2212, 2222 of the two locking latches 221, 222 comprise two inclining ridges 2213, 2223 engaged with the inclining slots 2311, 2312 respectively. Each of the inclining ridges 2213, 2223 has the same degree as the relative inclining slot 2311, 2312. Therefore, when the relative inclining ridges 2213, 2223 and the inclining slots 2311, 2312 are engaged together respectively, the transverse movement of the engaging element 231 into the hinge base 20 can drive the locking latches 221, 222 moving longitudinally. Referring to FIG. 11, when the engaging element 231 is pushed back in the direction of the arrow, the two latches 221, 222 will be withdrawn to the center in the direction of the arrows. At the end, the two locking latches 221, 222 are totally withdrawn and in the releasing status. On the contrary, when the engaging element 231 is pushed forward against the arrow, the two locking latches 221, 222 will be extent longitudinally against the arrows. At the end, the two locking latches 221, 222 are totally extent and in the locking status. Also, when pushing the hinge body 10 forward to couple the hinge body 10 with the hinge base 20, the two locking teeth 12 will push the two locking latches 221, 222 to move towards the center of the hinge base 10, and simultaneously, the two locking latches 221, 222 will pull the engaging element 231 backward transversely.

The engaging element 231 also comprises a pushing spring 2313 and a push button 2314. One end of the pushing spring 2313 is located on the hinge base 20, and another end of the pushing spring 2313 is attached on the front edge of the engaging element 231. The pushing spring 2313 is compressed in transverse so it provides a pushing force continuously with the intention to push the engaging element 231 to move forward, and consequently to extend the locking latches 221, 222 and retain the locking status. Accordingly, the push button 2314 is transversely and slidably coupled at the hinge base 20 to drive the locking latches 221, 222 sliding longitudinally at the hinge base 20, wherein a portion of the push button 2314 is outwardly protruded from the hinge base 20 for being pressed the push button 2314 into the hinge base 20. The push button 2314 is on the back edge of the engaging element 231 which is opposite to the pushing spring 2313. Pushing the push button 2314 against the pushing spring 2313 moves the engaging element 231 backward and withdraws the locking latches 221, 222 in releasing status.

Figure 5:
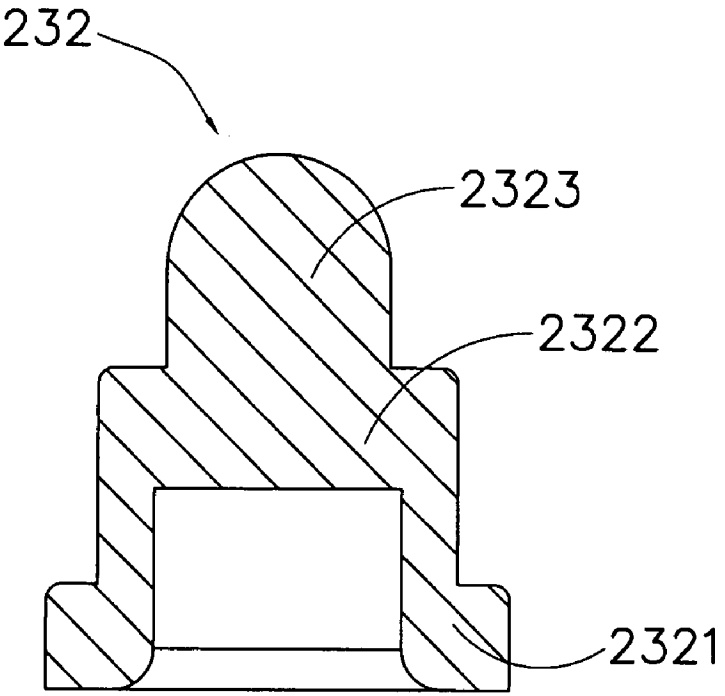
FIG. 5 is a sectional view of the button of the self-lock of the toilet seat hinge according to the above preferred embodiment of the present invention.
Figure 4:
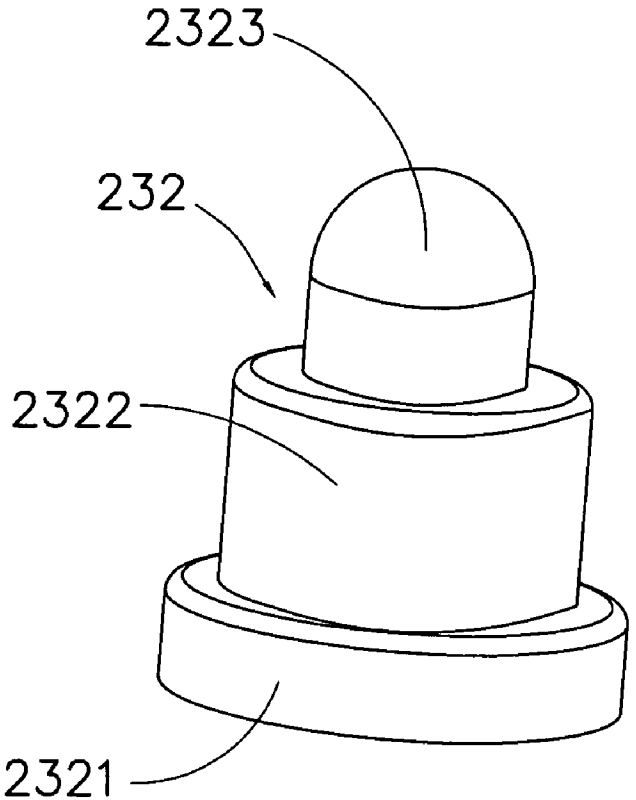
FIG. 4 is a perspective view of the toilet seat hinge according to the above preferred embodiment of the present invention, illustrating the button of the self-lock.

Referring to FIGS. 4 and 5, the locking pin 232 is in a shape of ladder-like column. It comprises a base 2321, a column 2322 over the base 2321, and a head 2323 over the column 2322. The diameter of the column 2322 is smaller than the diameter of the base 2321. The diameter of the head 2323 is smaller than the column 2322. The top of the head 2323 is in a round shape. Preferably, the head 2323 is formed by a column 2322 and a hemisphere with the same diameter. The self-lock 23 further comprises a pin spring 2324 and a spring seat 2325 at the bottom of the hinge base 20 to retain the pin spring 2324 in position. One end of the pin spring 2324 is received by the spring seat 2325. Another end of the pin spring 2324 is seated on the bottom of the hinge base 20. The pin spring 2324 is compressed so it provides a pushing force to the locking pin 232 upwardly. Accordingly, when the engaging element 231 is pressed transversely, the pin spring 2324 will push the locking pin 232 upwardly to lock up the engaging element 231 at the locking status.

Figure 3:
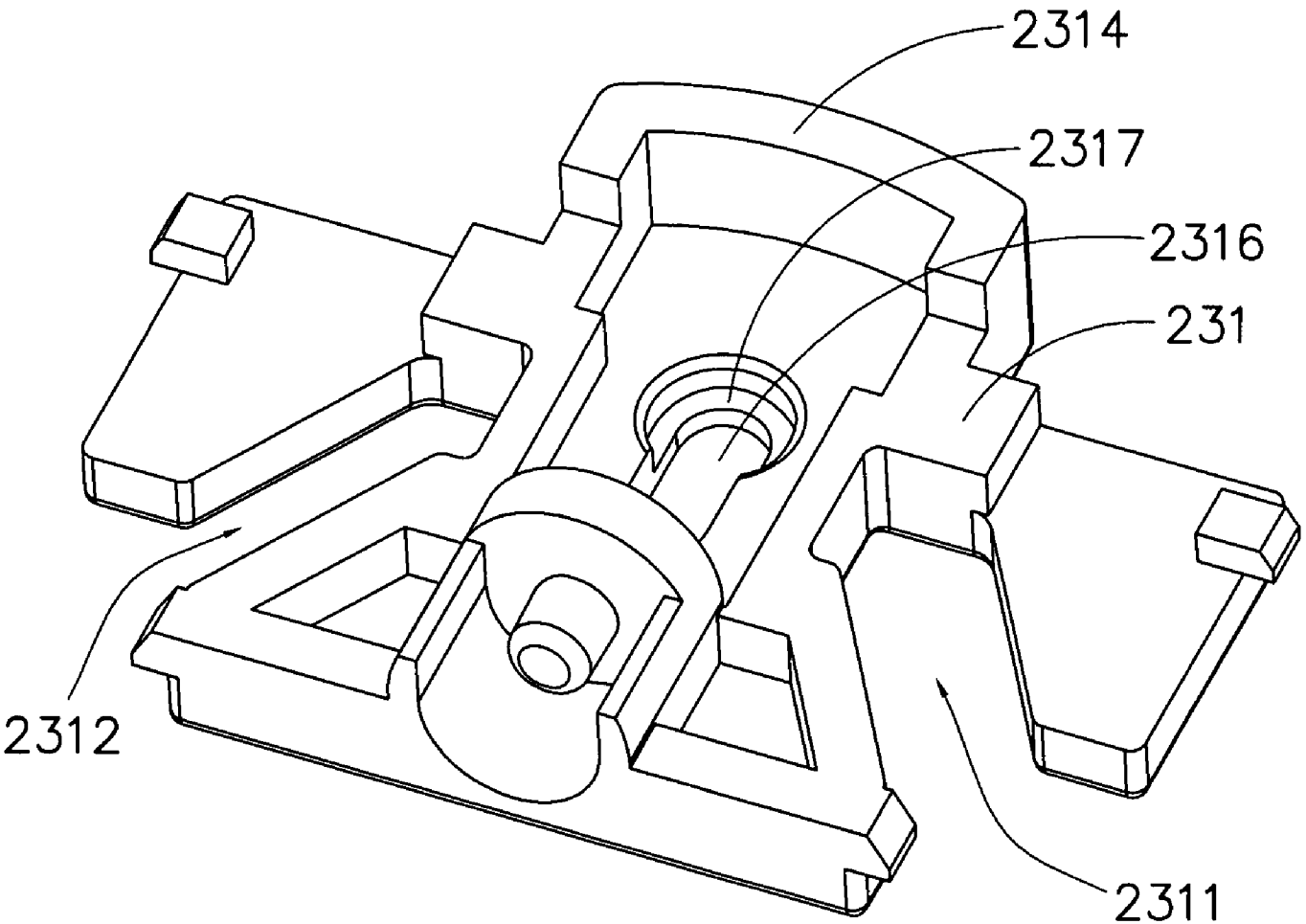
FIG. 3 is a perspective view of the toilet seat hinge according to the above preferred embodiment of the present invention, showing the back of the self-lock.

Referring to FIGS. 1 to 3, the engaging element 231 further comprises a through locking slot 2316 in the center thereof, and extends transversely. The width of the locking slot 2316 is the same as the diameter of the head 2323 of the locking pin 232, and is smaller than the diameter of the column 2322 of the locking pin 232. The thickness of the locking slot 2316 is smaller than the height of the head 2323 of the locking pin 232. The locking pin 232 with the pin spring 2324 is positioned vertically on the hinge base 20, and the engaging element 231 is positioned over the locking pin 232 with the head 23223 of the locking pin 232 extending through the locking slot 2316. The locking pin 232 doesn't move transversely. So when the engaging element 231 is moving back and forth, the head 2323 of the locking pin 232 slides in the locking slot 2316 but the locking pin 232 remains in its original position.

Referring to FIG. 3, at the back of the engaging element 231, the locking slot 2316 comprises a ladder-like cavity 2317 at the back end thereof. The ladder-like cavity 2317 has the same diameter as the column 2322 of the locking pin 232. Therefore when the back end of the locking slot 2316 is moved over the locking pin 232, the ladder-like cavity 2317 provides a cavity to receive a portion of the column 2322. The locking pin 232 will then be lift up by the pin spring 2324. In the way, the pin head 2323 is exposed over the locking slot 2316, and the upper portion of the column 2322 stays in the ladder-like cavity 2317. Because the diameter of the column 2322 is larger than the width of the locking slot 2316, when the upper portion of the column 2322 stays in the ladder-like cavity 2317, it prevents the engaging element 231 from moving transversely. Therefore, at this status, the self-lock 23 is locked, and the retention lock 22 is remained in releasing status. Then, if the head 2323 of the locking pin 232 is pushed down until the column 2322 disengaged from the ladder-like cavity 2317, the engaging element 231 can move transversely again.

In other words, when the engaging element 231 is moved transversely at the locking status, the column 2322 of the locking pin 232 is upwardly slid to engage with the ladder-like cavity 2317 so as to lock up the engaging element 231 in position. When the head 2323 of the locking pin 232 is downwardly pressed, the column 2322 of the locking pin 232 is downwardly slid to disengage with the ladder-like cavity 2317 so as to enable the engaging element 232 transversely sliding out of the hinge base 20 at its original position.

Figure 12:
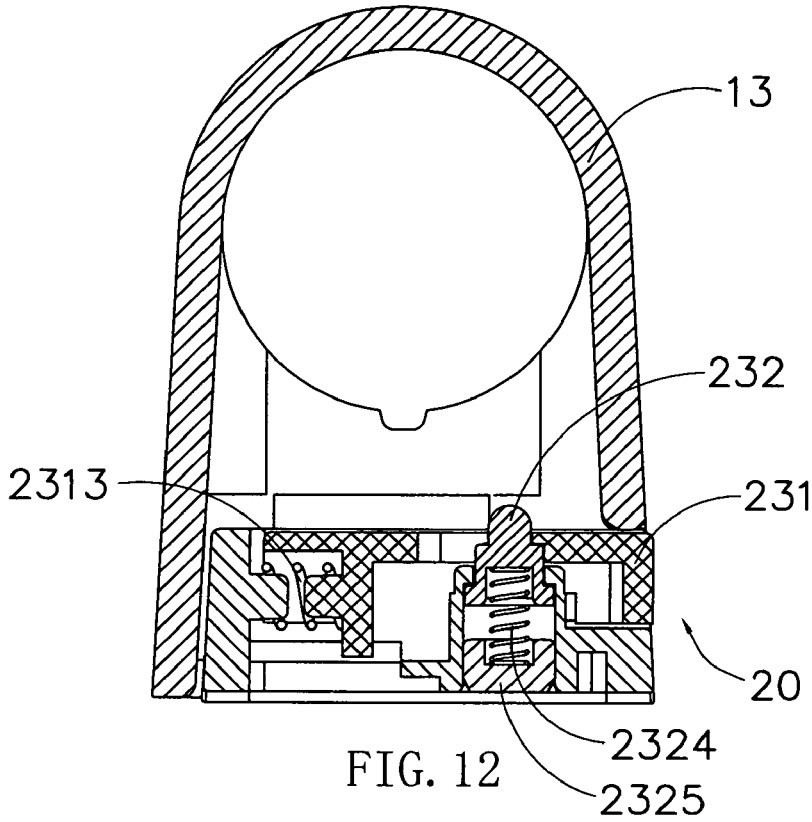
FIG. 12 is a sectional view of the toilet seat hinge according to the above preferred embodiment of the present invention, illustrating the hinge lock in releasing status, and the self-lock being locked when the hinge body is coupled with the hinge base.
Figure 13:
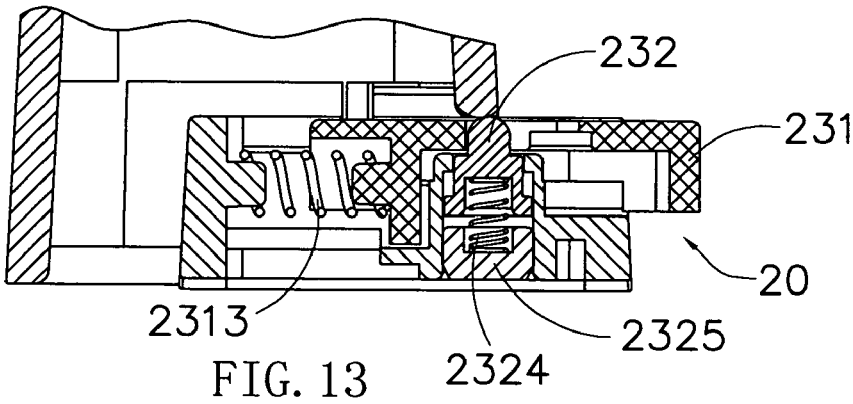
FIG. 13 is a sectional view of the toilet seat hinge according to the above preferred embodiment of the present invention, illustrating the self-lock being unlocked by the hinge body.
Figure 14:
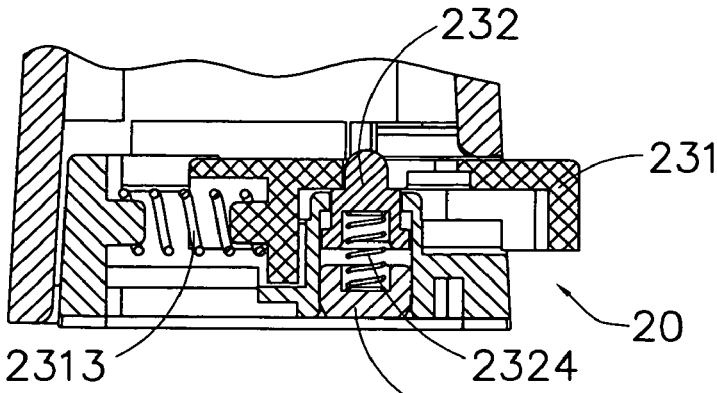
FIG. 14 is a sectional view of the toilet seat hinge according to the above preferred embodiment of the present invention, illustrating the hinge lock in locking status, and the self-lock being unlocked when the hinge body is coupled with the hinge base.

Referring to FIGS. 12 to 14, with the locking arrangement of the present invention, the hinge body 10 and the hinge base 20 can be easily coupled and lock, then be disengaged and detached.

Referring to FIG. 14, when the hinge body 10 and the hinge base 20 are coupled and the retention lock 22 is in locking status, the two locking latches 221, 222 are extended, the engaging element 231 is pushed back by the pushing spring 2313, and the pin head 2323 is in the front end of the locking slot 2316 with the pin spring 2324 being compressed.

Referring to FIG. 12, when the user wants to detach the hinge body 10 from the hinge base 20 to remove the toilet seat 30, the user just needs to push the push button 2314 of the engaging element 231. When the engaging element 231 is being pushed backward, the locking latches 221, 222 of the retention lock 22 are withdrawn to the releasing status. At the same time, when the ladder-like cavity 2317 is moved over the locking pin 232, the column 2322 of the locking pin 232 is pushed into the ladder-like cavity 2317 by the pin spring 2324 and the position of the engaging element 231 is retained. At this moment, the releasing status of the retention lock 22 is locked by the self-lock 23. The user then can release the pushing force on the push button 2314 and free his/her hands. Since the retention lock 22 is released, now the user can simple pull the toilet seat 30 with the hinge body 10 backward to detached the hinge body 10 from the hinge base 20, so as to detach the toilet seat 30 from the toilet bowl 40.

Figure 9:
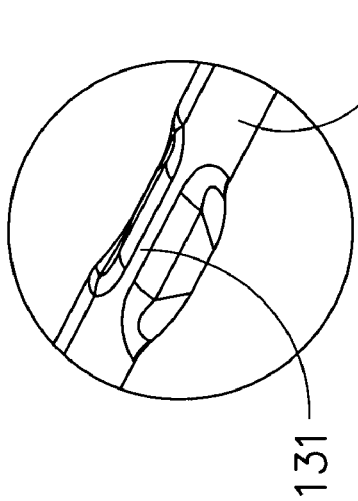
FIG. 9 is a partially enlarged view of the hinge body according to the above preferred embodiment of the present invention.
Figure 8:
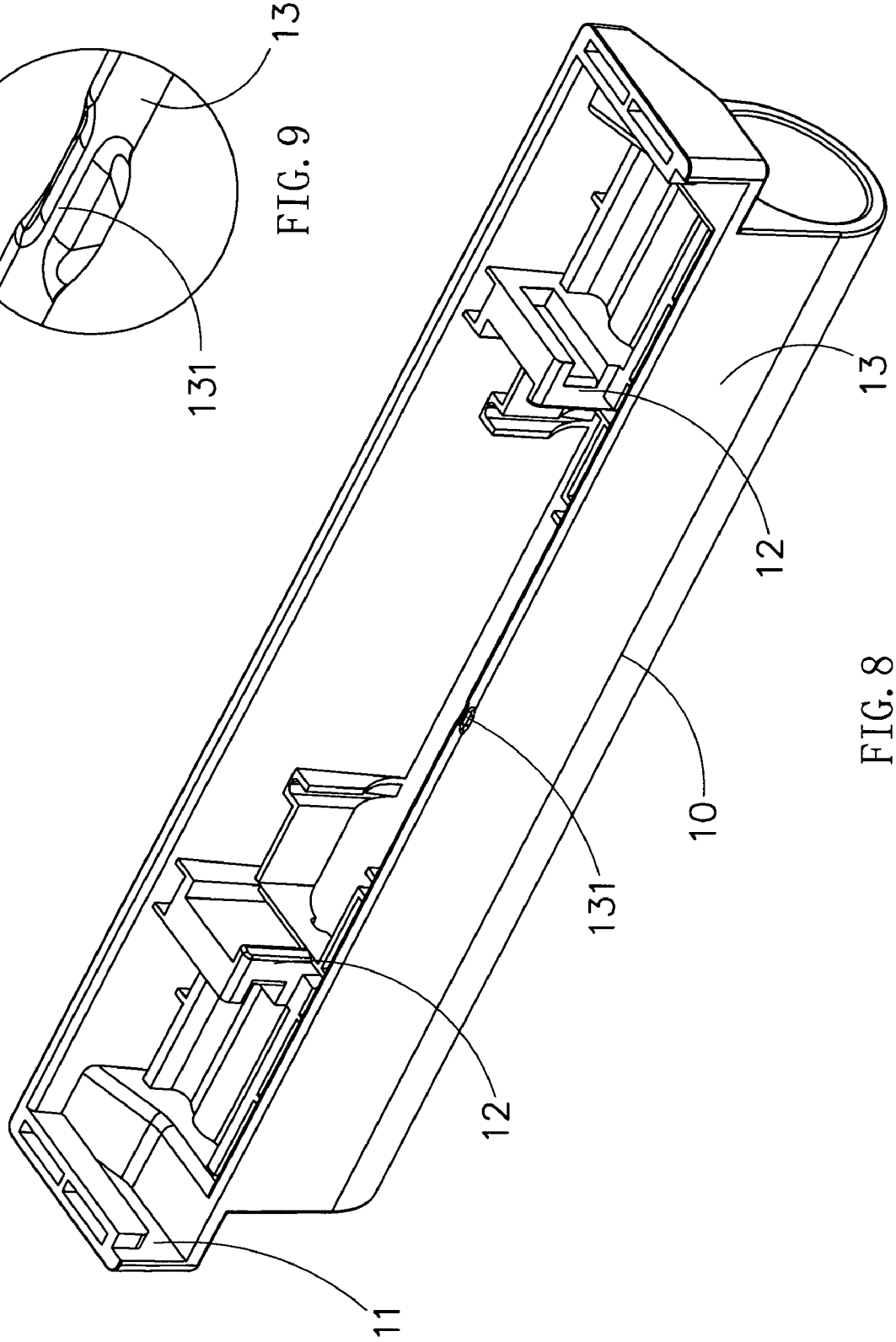
FIG. 8 is a perspective view of the hinge body according to the above preferred embodiment of the present invention.
Figure 10:
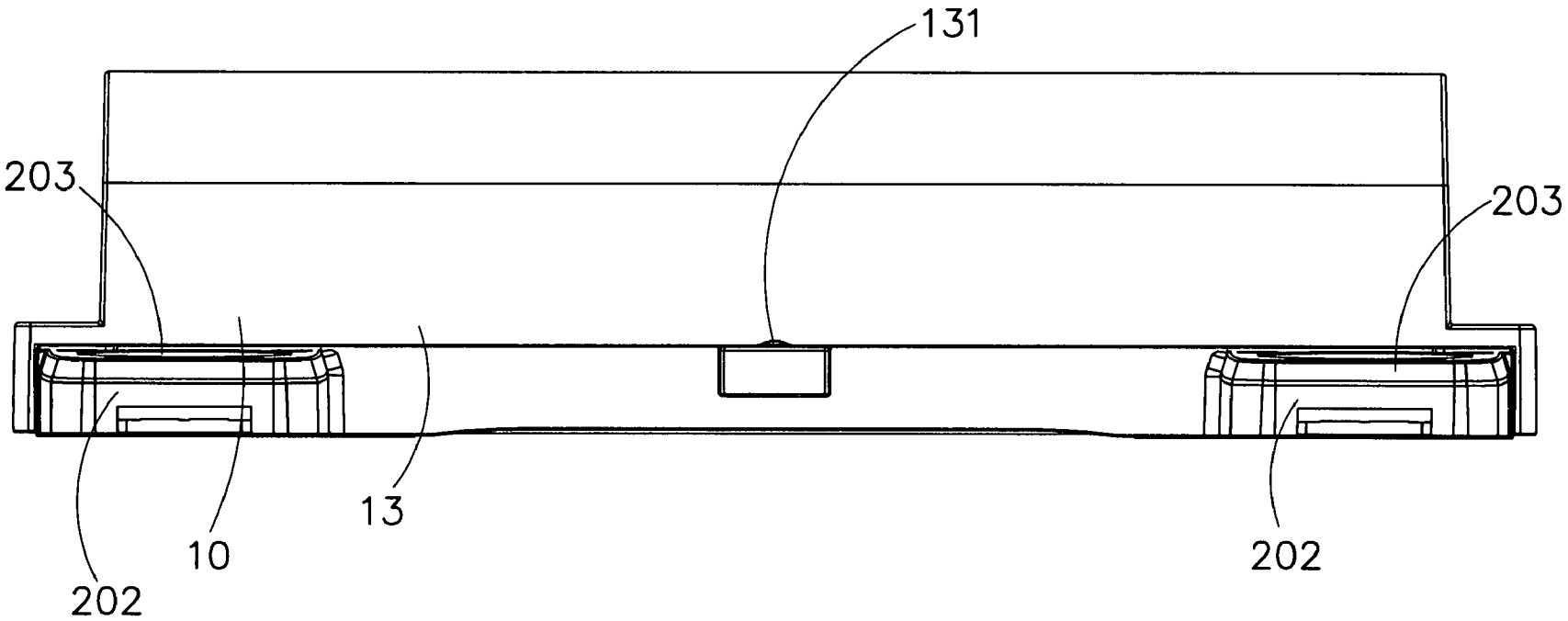
FIG. 10 is a front view of the hinge body according to the above preferred embodiment of the present invention.

Referring to FIG. 13, when the hinge body 10 is pulled away from the hinge base 20, the back wall 13 of the hinge body 10 will slide over the head 2323 of the locking pin 232. As the upper portion of the head 2323 is hemisphere, the locking pin 232 is pushed down by the back wall 13. Therefore the column 2322 of the locking pin 232 is moved out of the ladder-like cavity 2317. As a result, the engaging element 231 is pushed forward by the pushing spring 2313. The self-lock 23 then releases the releasing status of the retention lock 22, and the retention lock 22 returns back to locking status. Referring to FIGS. 8 and 9, it is worth mentioning, the bottom edge of the back wall 13 of the hinge body 10 has a pressing indention 131 for the convenience to push the head 2323 of the locking pin 232. Accordingly, when the hinge body 10 is slidably engaged with the hinge base 20, the pressing indention 131 is alignedly slid to downwardly press at the head 2323 of the locking pin 232 so as to unlock the locking pin 232. In other words, during the installation of the hinge body 10, the head 2323 of the locking pin 232 is automatically pressed to ensure the release of the self-lock 23. So, after the hinge body 10 is mounted at the hinge base 20, the retention lock 22 is returned back to its locking status so as to ensure the hinge body 10 being locked at the hinge base 20.

When the user needs to install the toilet seat 30 back, he/she just need to align the sliding slots 11 of the hinge body 10 with the sliding ridges 21 of the hinge base 20 respectively and push the hinge body 10 forwardly. If at this moment, the hinge base 20 is at releasing status, the back wall 13 of the hinge body 10 will first push the head 2323 of the locking pin 232 to release the self-lock 23 and returns the retention lock 22 to locking status. This is important because when the hinge body 10 and the hinge base 20 are coupled together, they need to be locked. If the retention lock 22 is already in locking status, the hinge body 10 will move forward continuously. The two locking teeth 12 of the hinge body 10 will push the two locking latches 221, 222 towards the center of the hinge base 20. When the locking teeth 12 pass by, the two locking latches 221, 222 extend again and block the locking teeth 12 to move back. The reason is the pushing spring 2313 intends to push the engaging element 231 forward and extend the two locking latches 221, 222. Also, when the two locking latches 221, 222 are pushed towards each other, the ladder-like cavity 2317 is pulled back with the engaging element 231 but hasn't reached the locking pin 232 yet and won't lock the retention lock 22 in releasing status. When the two locking latches 221, 222 are fully extent, the retention lock 22 is in locking status, the coupling of the hinge body 10 and the hinge base 20 are secured.

In summary, using the present invention, the user can easily remove the toilet seat 30 from the toilet bowl 40 by pushing the push button 2314, and pulling the toilet seat 30 with the hinge body 10. To reinstall, just pushing the hinge body 10 to the end of the hinge base 20 is enough. During the operation, no tools are needed, no hand or finger need to keep pushing on any button. Even one hand can handle the operation. Since the toilet seat 30 and the hinge body 10 can be easily removed, the user can clean them much more conveniently. Because the hinge body 10 covers the hinge base 20 thoroughly, the hinge base 20 will keep clean.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A toilet seat hinge for toilet having a toilet seat and a toilet bowl, comprising:

a hinge body adapted for pivotally coupling with said toilet seat;

a hinge base, which is adapted for attaching on said toilet bowl of said toilet, detachably coupled with said hinge body for detachably coupling said toilet seat on said toilet bowl; and a locking arrangement which comprises a retention lock operatively moving between a locking status that locks up said hinge body with said hinge base and a releasing status that unlock said hinge body with said hinge base, and a self-lock retaining said retention lock at said releasing status;

wherein said retention lock comprises two locking latches slidably and longitudinally coupled at said hinge base and two locking teeth spacedly provided at said hinge body and arranged in such a manner that when said locking latches are longitudinally slid away from each other to engage with said locking teeth respectively, said hinge body is coupled with said hinge base, and when said locking latches are longitudinally slid towards each other to disengage with said locking teeth, said hinge body is adapted to be detached from said hinge base;

wherein each of said locking latches comprises an inclining end contacting with said respective locking tooth in which a distance between said locking teeth is shorter than a distance between said two inclining ends of said locking latches, wherein when said hinge body is coupled with said hinge base, said inclining ends of said locking latches are slid along said locking teeth to push said locking latches towards each other until said inclining ends of said locking latches engage with said locking teeth respectively.

2. The toilet seat hinge, as recited in claim 1, wherein said self-lock comprises an engaging element engaged between said locking latches and being transversely moved into said hinge base to drive said locking latches to slide longitudinally towards each other so as to disengage with said locking teeth.

3. The toilet seat hinge, as recited in claim 2, wherein said engaging element comprises two spaced apart inclining slots engaging with two engaging ends of said locking latches respectively, in such a manner that when said engaging element is pressed transversely, said locking latches are driven to slide longitudinally to disengage with said locking teeth respectively.

4. The toilet seat hinge, as recited in claim 3, wherein said self-lock further comprises a locking pin upwardly and slidably extended through a locking slot of said engaging element and a pin spring supported on said hinge base for applying an upward force against said locking pin, wherein when said engaging element is moved transversely at said locking status, said locking pin is upwardly pushed via said pin spring to lock up said engaging element at said locking status.

5. The toilet seat hinge, as recited in claim 4, wherein said locking slot has a ladder-like cavity at one end of said locking slot with a diameter larger than the width of said locking slot, wherein said locking pin comprises a column with a diameter as same as the diameter of said ladder-like cavity, and a head extended above said engaging element with a diameter as same as the diameter of said locking slot, wherein when said engaging element is moved transversely at said locking status, said column of said locking pin is upwardly slid to engage with said ladder-like cavity so as to lock up said engaging element in position, and when said head of said locking pin is downwardly pressed, said column of said locking pin is downwardly slid to disengage with said ladder-like cavity so as to enable said engaging element transversely sliding out of said hinge base.

6. The toilet seat hinge, as recited in claim 5, wherein said hinge body further has a pressing indention provided at a bottom edge of a back wall of said hinge body and arranged in such a manner that when said hinge body is slidably engaged with said hinge base, said pressing indention is alignedly slid to downwardly press at said head of said locking pin so as to unlock said locking pin.

7. The toilet seat hinge, as recited in claim 5, wherein said engaging element comprises a push button transversely and slidably coupled at said hinge base to drive said locking latches sliding longitudinally at said hinge base, and a pushing spring supported in said hinge base for applying a transversely pushing force against said push button at a position that a portion of said push button is outwardly protruded from said hinge base, such that said push button is adapted to be pressed into said hinge base to unlock said hinge body from said hinge base.

8. The toilet seat hinge, as recited in claim 7, wherein said hinge body further has a pressing indention provided at a bottom edge of a back wall of said hinge body and arranged in such a manner that when said hinge body is slidably engaged with said hinge base, said pressing indention is alignedly slid to downwardly press at said head of said locking pin so as to unlock said locking pin.

9. The toilet seat hinge, as recited in claim 8, wherein said hinge body has two sliding slots transversely provided at two side ends thereof, wherein said hinge base has two sliding ridges transversely provided at two side ends thereof and arranged in such a manner that when said sliding ridges are slidably engaged with said sliding slots respectively, said hinge body is slidably coupled with said hinge base to encase said retention lock within said hinge body and said hinge base.

10. The toilet seat hinge, as recited in claim 9, wherein said hinge body is backwardly slid to couple with said hinge base and is forwardly slid to detach from said hinge base.

11. The toilet seat hinge, as recited in claim 2, wherein said self-lock further comprises a locking pin upwardly and slidably extended through a locking slot of said engaging element and a pin spring supported on said hinge base for applying an upward force against said locking pin, wherein when said engaging element is moved transversely at said locking status, said locking pin is upwardly pushed via said pin spring to lock up said engaging element at said locking status.

12. The toilet seat hinge, as recited in claim 11, wherein said locking slot has a ladder-like cavity at one end of said locking slot with a diameter larger than the width of said locking slot, wherein said locking pin comprises a column with a diameter as same as the diameter of said ladder-like cavity, and a head extended above said engaging element with a diameter as same as the diameter of said locking slot, wherein when said engaging element is moved transversely at said locking status, said column of said locking pin is upwardly slid to engage with said ladder-like cavity so as to lock up said engaging element in position, and when said head of said locking pin is downwardly pressed, said column of said locking pin is downwardly slid to disengage with said ladder-like cavity so as to enable said engaging element transversely sliding out of said hinge base.

13. The toilet seat hinge, as recited in claim 12, wherein said engaging element comprises a push button transversely and slidably coupled at said hinge base to drive said locking latches sliding longitudinally at said hinge base, and a pushing spring supported in said hinge base for applying a transversely pushing force against said push button at a position that a portion of said push button is outwardly protruded from said hinge base, such that said push button is adapted to be pressed into said hinge base to unlock said hinge body from said hinge base.

14. The toilet seat hinge, as recited in claim 2, wherein said hinge body has two sliding slots transversely provided at two side ends thereof, wherein said hinge base has two sliding ridges transversely provided at two side ends thereof and arranged in such a manner that when said sliding ridges are slidably engaged with said sliding slots respectively, said hinge body is slidably coupled with said hinge base to encase said retention lock within said hinge body and said hinge base.

15. The toilet seat hinge, as recited in claim 14, wherein said hinge body is backwardly slid to couple with said hinge base and is forwardly slid to detach from said hinge base.

16. A toilet seat hinge for toilet having a toilet seat and a toilet bowl, comprising:

a hinge body adapted for pivotally coupling with said toilet seat;

a hinge base, which is adapted for attaching on said toilet bowl of said toilet, detachably coupled with said hinge body for detachably coupling said toilet seat on said toilet bowl; and a locking arrangement which comprises a retention lock operatively moving between a locking status that locks up said hinge body with said hinge base and a releasing status that unlock said hinge body with said hinge base, and a self-lock retaining said retention lock at said releasing status;

wherein said retention lock comprises two locking latches slidably and longitudinally coupled at said hinge base and two locking teeth spacedly provided at said hinge body and arranged in such a manner that when said locking latches are longitudinally slid away from each other to engage with said locking teeth respectively, said hinge body is coupled with said hinge base, and when said locking latches are longitudinally slid towards each other to disengage with said locking teeth, said hinge body is adapted to be detached from said hinge base;

wherein said self-lock comprises an engaging element engaged between said locking latches and being transversely moved into said hinge base to drive said locking latches to slide longitudinally towards each other so as to disengage with said locking teeth.

17. The toilet seat hinge, as recited in claim 16, wherein said engaging element comprises two spaced apart inclining slots engaging with two engaging ends of said locking latches respectively, in such a manner that when said engaging element is pressed transversely, said locking latches are driven to slide longitudinally to disengage with said locking teeth respectively.

* * * * *